US012605585B1

(12) United States Patent
Yang

(10) Patent No.: US 12,605,585 B1
(45) Date of Patent: Apr. 21, 2026

(54) MULTIFUNCTIONAL EXERCISE APPARATUS

(71) Applicant: YANGZHOU JIUYI HARDWARE & MACHINERY CO., LTD., Yangzhou (CN)

(72) Inventor: Yen-Shuo Yang, Taichung City (TW)

(73) Assignee: YANGZHOU JIUYI HARDWARE & MACHINERY CO., LTD., Yangzhou (CN)

( * ) Notice: Subject to any disclaimer, the term of this patent is extended or adjusted under 35 U.S.C. 154(b) by 83 days.

(21) Appl. No.: 18/919,715

(22) Filed: Oct. 18, 2024

(51) Int. Cl.
*A63B 21/00* (2006.01)

(52) U.S. Cl.
CPC ..... *A63B 21/156* (2013.01); *A63B 21/00065* (2013.01); *A63B 2225/093* (2013.01)

(58) Field of Classification Search
CPC ..... A63B 21/00065; A63B 21/04; A63B 21/0407; A63B 21/0414; A63B 21/055; A63B 21/0552; A63B 21/0557; A63B 21/062; A63B 21/0626; A63B 21/0628; A63B 21/063; A63B 21/0632; A63B 21/154; A63B 21/156; A63B 2225/09; A63B 2225/093
See application file for complete search history.

(56) References Cited

U.S. PATENT DOCUMENTS

| | | | | |
|---|---|---|---|---|
| 7,654,942 | B1 * | 2/2010 | Batca | A63B 21/4043 482/99 |
| 8,172,733 | B1 * | 5/2012 | Batca | A63B 21/0628 482/99 |
| 11,458,350 | B2 * | 10/2022 | Yang | A63B 21/00065 |
| 12,017,106 | B2 * | 6/2024 | Yang | A63B 21/156 |
| 12,172,044 | B2 * | 12/2024 | Yang | A63B 21/156 |
| 2022/0096891 | A1 * | 3/2022 | Yang | A63B 21/0428 |
| 2024/0131382 | A1 * | 4/2024 | Yang | A63B 21/156 |
| 2024/0131387 | A1 * | 4/2024 | Yang | A63B 21/156 |
| 2024/0226638 | A9 * | 7/2024 | Yang | A63B 21/4035 |
| 2024/0226643 | A9 * | 7/2024 | Yang | A63B 21/156 |

FOREIGN PATENT DOCUMENTS

CN 205683489 U * 11/2016

* cited by examiner

*Primary Examiner* — Gary D Urbiel Goldner

(57) ABSTRACT

A multifunctional exercise apparatus includes a main frame including a base seat and a supporting unit, a resistance unit including a weight subunit and an elastic subunit, and a transmission unit. The transmission unit includes first and second fixed pulley sets, a first movable pulley set connected to the resistance unit, two second movable pulley sets, an upper cable looped around the first fixed pulley set, the first movable pulley set, and the two second movable pulley sets, and two lower cables looped around the second fixed pulley set, respectively looped around the two second movable pulley sets, and connected to the base seat and the supporting unit.

5 Claims, 17 Drawing Sheets

MULTIFUNCTIONAL EXERCISE APPARATUS

FIELD

The disclosure relates to an exercise apparatus, and more particularly to a multifunctional exercise apparatus.

BACKGROUND

A conventional exercise apparatus disclosed in Chinese Utility Model Patent No. CN205683489 U includes a base seat, a connecting pillar extending perpendicularly from the base seat, and a top beam connected to the connecting pillar and parallel to a main body of the base seat. A rear portion of the top beam is connected to a resistance unit via two guiding posts. The conventional exercise apparatus further includes a first fixed pulley and a second fixed pulley that are respectively mounted to a front portion and the rear portion of the top beam, and a steel cable that is looped around the first fixed pulley and the second fixed pulley and that has one end co-movably connected to an operating handle and another end connected to the resistance unit.

A user may perform weight training by pulling the operating handle so the resistance unit is lifted by the steel cable.

However, such conventional exercise apparatus may only be useful for weight training or strength training, and is not suitable for cardio training since the resistance unit moves slowly in response to operation of the operating handle. This is due to inertia of the resistance unit, which causes the resistance unit to have a delayed fall under gravity after the resistance unit is lifted and reaches a highest point, and thus a short pause is produced before the delayed fall. In addition, resistance forces such as a frictional force between the resistance unit and the guiding posts, a frictional force between the steel cable and the first and second fixed pulleys, and a frictional force between bearings and the first and second fixed pulleys may slow down the resistance unit to free fall and return to its original position. Consequently, the conventional exercise apparatus is not suitable for cardio exercises such as rowing, skiing, and boxing that involve quick movements.

SUMMARY

Therefore, an object of the disclosure is to provide a multifunctional exercise apparatus that can alleviate at least one of the drawbacks of the prior art.

According to an aspect of the present disclosure, a multifunctional exercise apparatus includes a main frame, a resistance unit, a transmission unit, and an operation unit. The main frame includes a base seat and a supporting unit connected to the base seat. The resistance unit includes a weight subunit connected to the main frame, and an elastic subunit connected between the weight subunit and the main frame. The transmission unit includes a first fixed pulley set mounted on the supporting unit, a second fixed pulley set mounted on the base seat, a first movable pulley set connected to the resistance unit, two second movable pulley sets disposed respectively at two lateral sides of the first movable pulley set, an upper cable looped around the first fixed pulley set, the first movable pulley set, and the second movable pulley sets, and two lower cables looped around the second fixed pulley set and respectively looped around the second movable pulley sets. Each of the lower cables has one end positioned to the base seat and another end connected to the supporting unit. The operation unit includes at least one operating member connected to one end of the upper cable.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
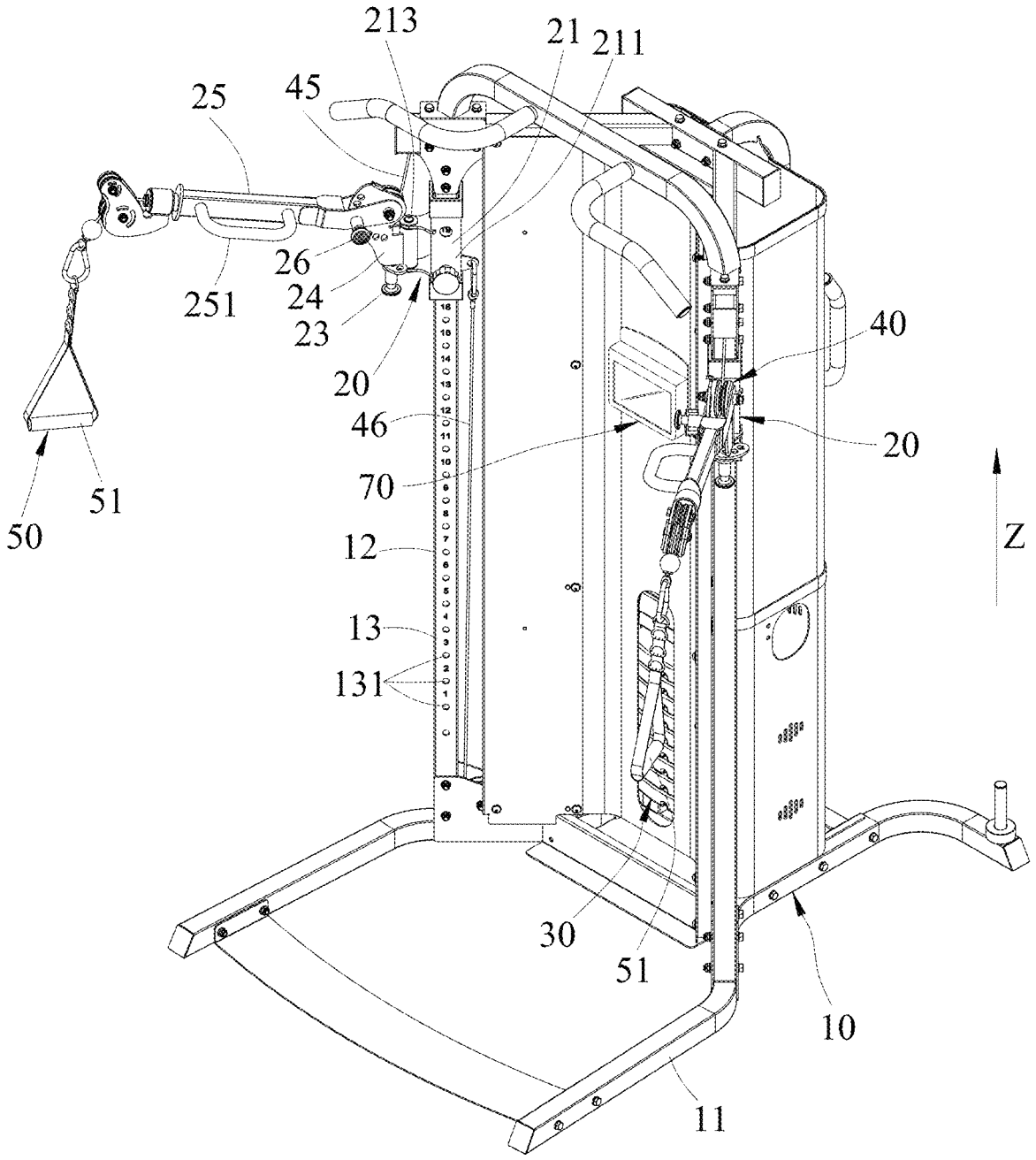
FIG. 1 is a perspective view of an embodiment of a multifunctional exercise apparatus according to the present disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
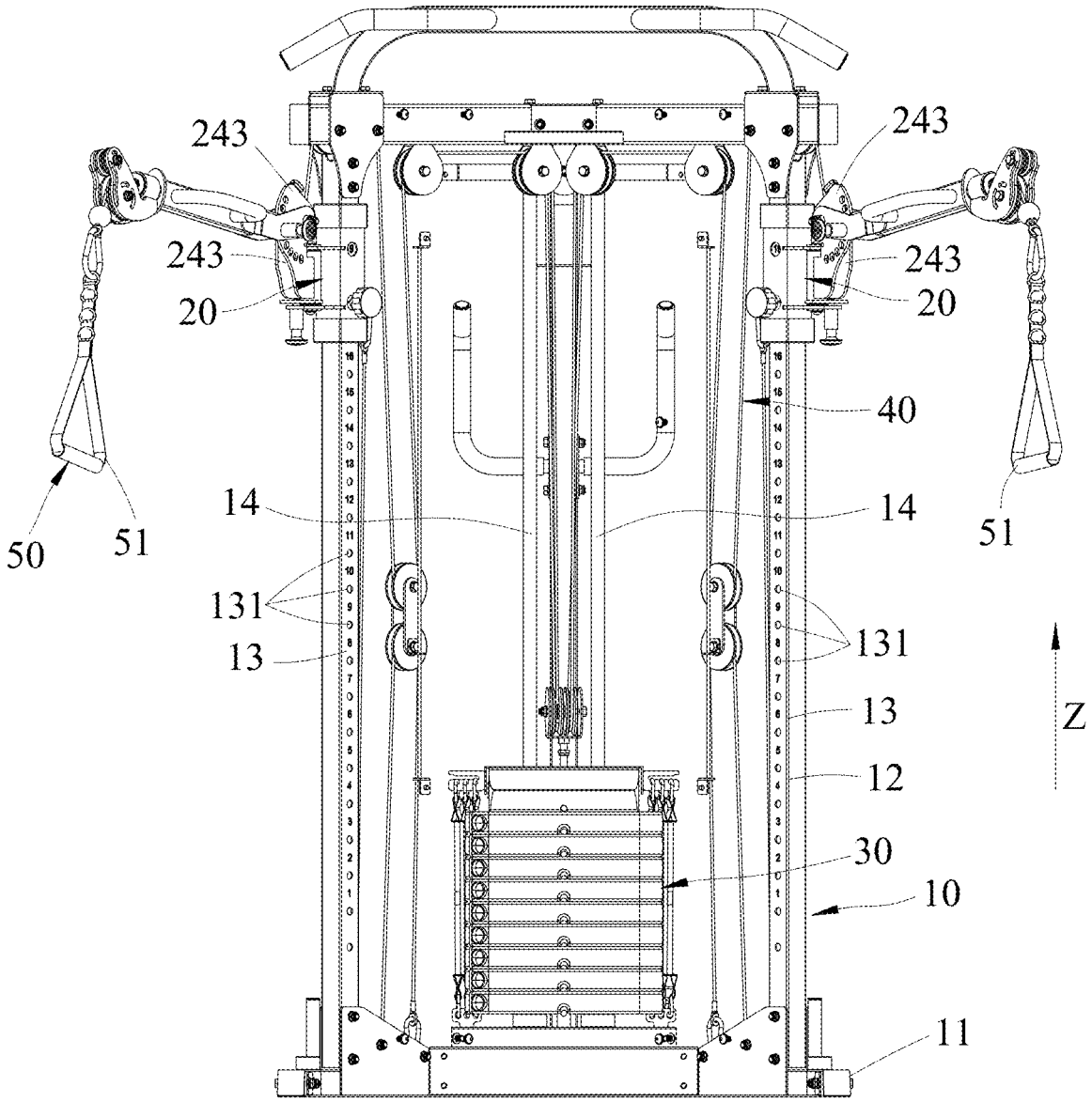
FIG. 2 is a schematic front view of the embodiment, illustrating a pair of adjusting units of the embodiment mounted respectively to two upright posts of the main frame of the embodiment.

Referring to FIGS. 1 and 2, a multifunctional exercise apparatus of an embodiment according to the present disclosure includes a main frame 10, two adjusting units 20, a resistance unit 30, a transmission unit 40, and an operation unit 50.

The main frame 10 includes a base seat 11, and a supporting unit 12 connected to the base seat 11. The supporting unit 12 includes two upright posts 13 extending upwardly from the base seat 11 in a vertical direction (Z), and two guide rods 14 extending upwardly from the base seat 11 in the vertical direction (Z) and disposed between the upright posts 13. Each of the upright posts 13 has a plurality of positioning holes 131 spaced apart from each other in the vertical direction (Z).

Figure 3:
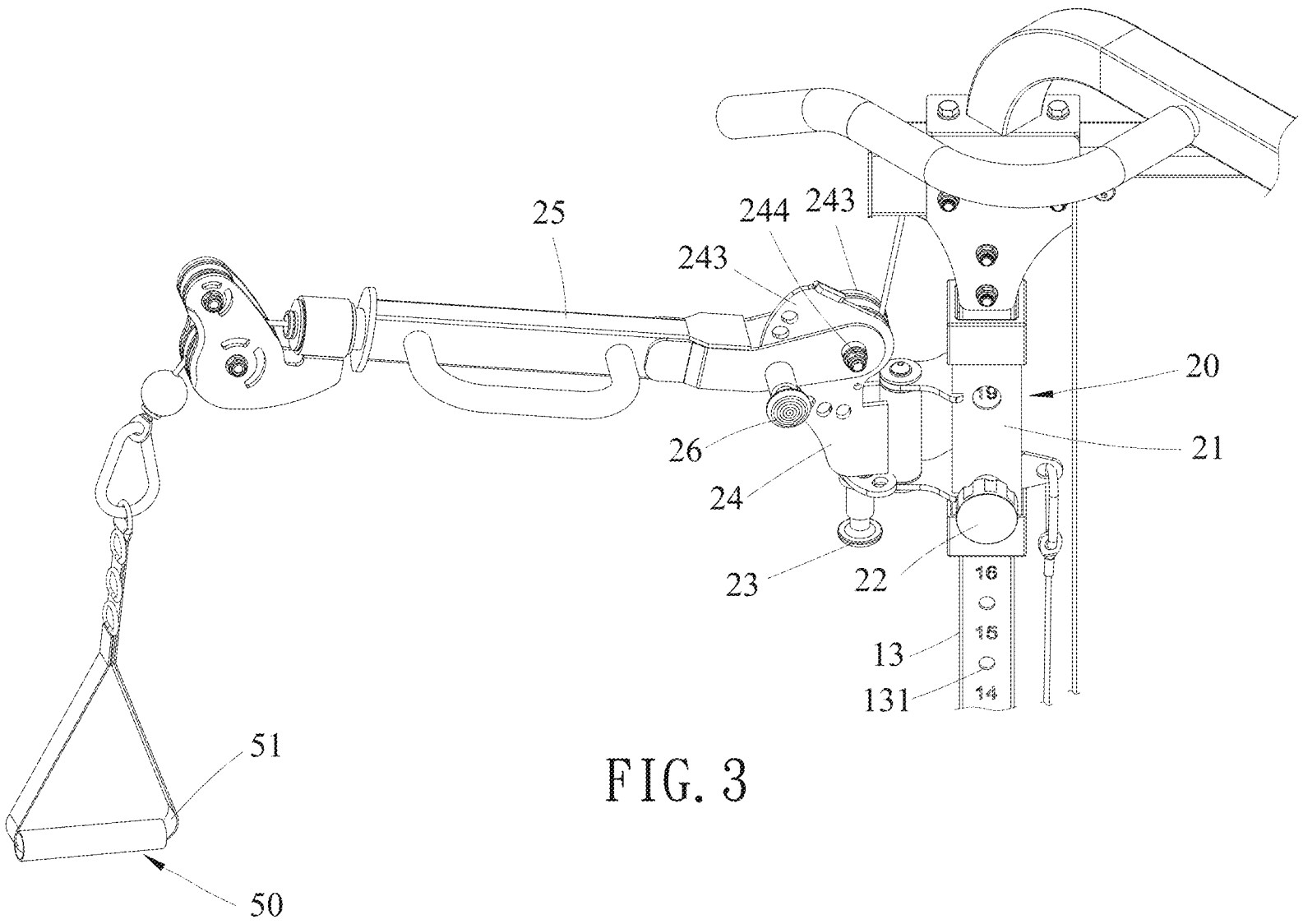
FIG. 3 is a fragmentary enlarged perspective view of the embodiment.
Figure 4:
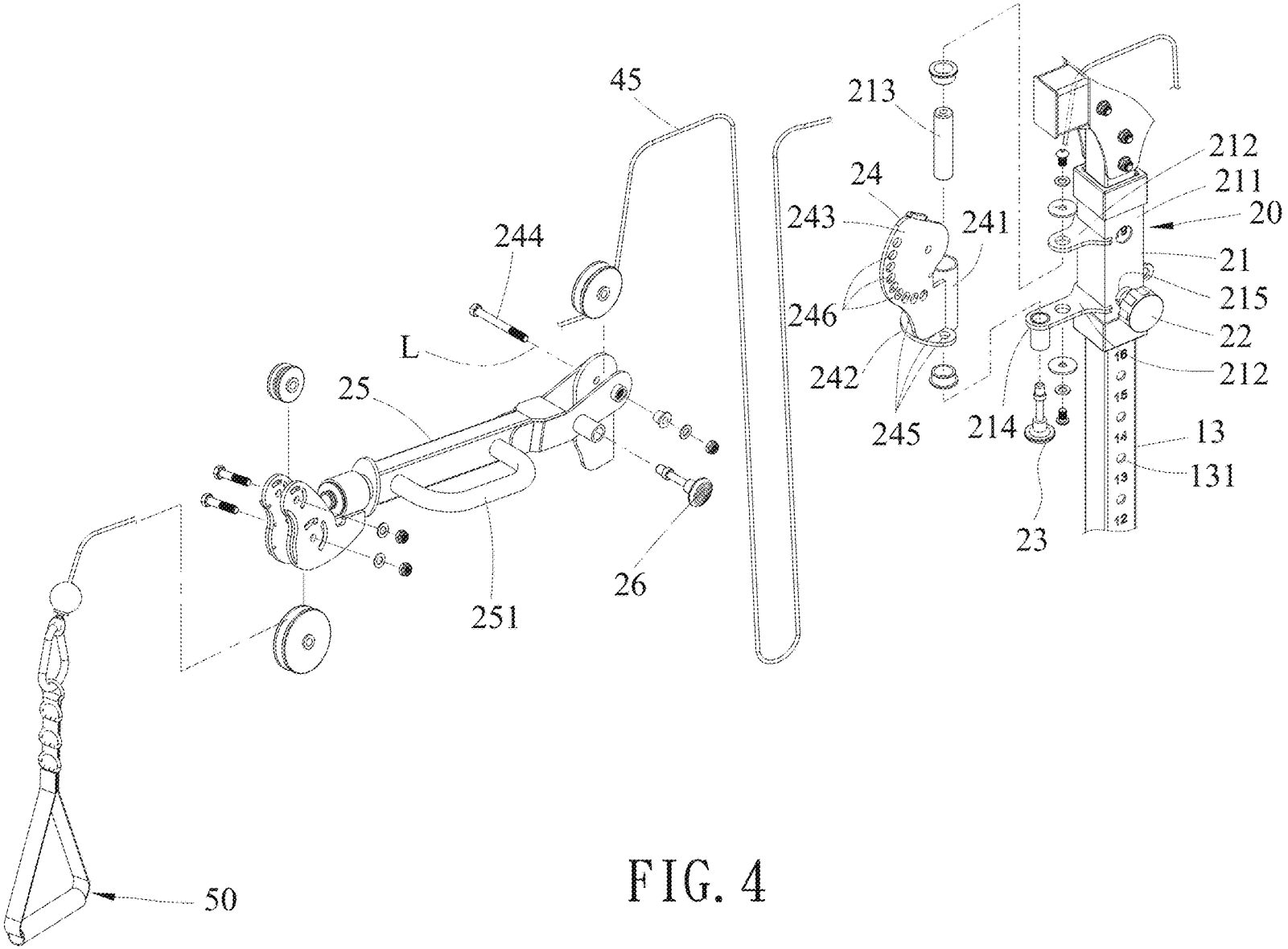
FIG. 4 is a partly exploded perspective view of FIG. 3.

Further referring to FIGS. 3 and 4, each of the adjusting units 20 is movable along a respective one of the upright posts 13. Each of the adjusting units 20 including a slide seat 21 slidably sleeved on the respective one of the upright posts 13, a positioning pin 22 mounted on the slide seat 21, a first insert pin 23 mounted to the slide seat 21, a rotary seat 24 pivotably connected to the slide seat 21, a swing arm 25 pivotably connected to the rotary seat 24, and a second insert pin 26 mounted to the swing arm 25. It should be noted that since the structures of the adjusting units 20 are identical, only one of the adjusting units 20 and the respective one of the upright posts 13 are described in the following descriptions for the sake of brevity. The slide seat 21 has a sleeve member 211 slidably sleeved on the upright post 13, and two lug members 212 connected to the sleeve member 211 and spaced apart from each other in the vertical direction (Z), and a pivot shaft 213 extending through the lug members 212. The sleeve member 211 has a through hole 215. It should be noted that the number of the through hole 215 may be more than one in other embodiments. One of the lug members 212 has a pin hole 214. The positioning pin 22 extends removably through the through hole 215 and extends into a selected one of the positioning holes 131 of the upright post 13 so as to position the slide seat 21 relative to the upright post 13. The rotary seat 24 includes a tubular sleeve 241 rotatably connected to the pivot shaft 213, an adjusting plate 242 disposed on one of the lug members 212 and connected to the tubular sleeve 241, a pair of pivot plates 243 fixedly connected to the tubular sleeve 241, and a connecting pin 244 extending through the pivot plates 243 along an axis (L) transverse to the vertical direction (Z). An axial direction of the tubular sleeve 241 is parallel to the vertical direction (Z). The adjusting plate 242 has a plurality of first adjusting holes 245 that are arcuately arranged and that are disposed at an outer side of the tubular sleeve 241. One of the pivot plates 243 has a plurality of second adjusting holes 246 that are arcuately arranged around the axis (L). It should be noted that the other one of the pivot plates 243 that is not formed with the second adjusting holes 245 has a size smaller that of the one of the pivot plates 243, thus only one of the pivot plates 243 is clearly seen in FIGS. 3 and 4. The first insert pin 23 extends through the pin hole 214 of the one of the lug members 212, is mounted to the one of the lug members 212, and extends removably into a selected one of the first adjusting holes 245 of the adjusting plate 242. In this way, the first insert pin 23 positions the rotary seat 24 relative to the one of the lug member 212. The swing arm 25 is pivotably connected to the rotary seat 24 via the connecting pin 244, and has a handle 251. In this embodiment the handle 251 is provided for a user to hold the adjusting unit 20 when adjusting a height or an angle of the rotary seat 24 relative to the upright post 13 and adjusting an angle of the swing arm 25 relative to the rotary seat 24. The second insert pin 26 extends removably through a selected one of the second adjusting holes 246 of one of the pivot plates 24, thereby positioning the swing arm 25 relative to the one of the pivot plates 243.

Figure 7:
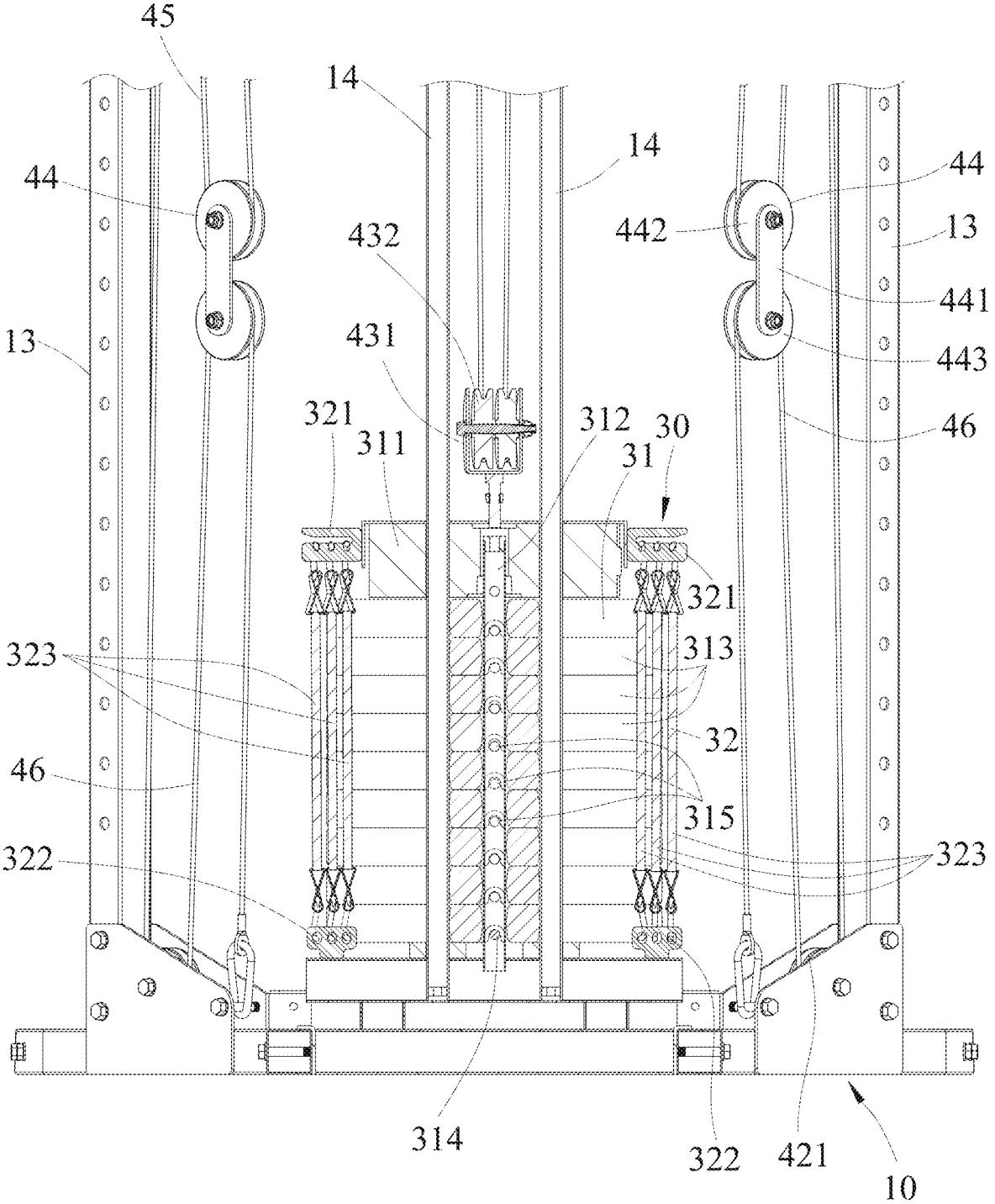
FIG. 7 is a sectional front view of a resistance unit of the embodiment.

Further referring to FIG. 7, the resistance unit 30 includes a weight subunit 31 connected to the main frame 10, and an elastic subunit 32 connected between the weight subunit 31 and the main frame 10. The weight subunit 31 includes a mounting seat 311 slidable along the guide rods 14, a selection rod 312 extending into the mounting seat 311, a plurality of weight plates 313 sleeved removably on the selection rod 312 and sleeved on the guide rods 14, and a selecting pin 314 extending removably through the selection rod 312 and a selected one of the weight plates 313. The selection rod 312 has a plurality of selection holes 315. The elastic subunit 32 includes two upper hooks 321 fixedly and respectively connected to two lateral sides of the mounting seat 311, two lower hooks 322 fixedly connected to the base seat 11 and respectively disposed at two lateral sides of the guide rods 14, and a plurality of elastic straps 323 disposed at two lateral sides of the weight subunit 31. Each of the elastic straps 323 is connected between a corresponding one of the upper hooks 321 and a corresponding one of the lower hooks 322, such that each of the elastic straps 323 has one end co-movably connected to the mounting seat 311 and an opposite end connected fixedly to the base seat 11. A number of the elastic straps 323 that are disposed at one of the two lateral sides of the weight subunit 31 is equal to a number of the elastic straps 323 that are disposed at another one of the two lateral sides of the weight subunit 31. The specifications of the elastic straps 323 are the same. In this embodiment, the number of the elastic straps 323 that are disposed at each of the two lateral sides of the weight subunit 31 is three.

Figure 5:
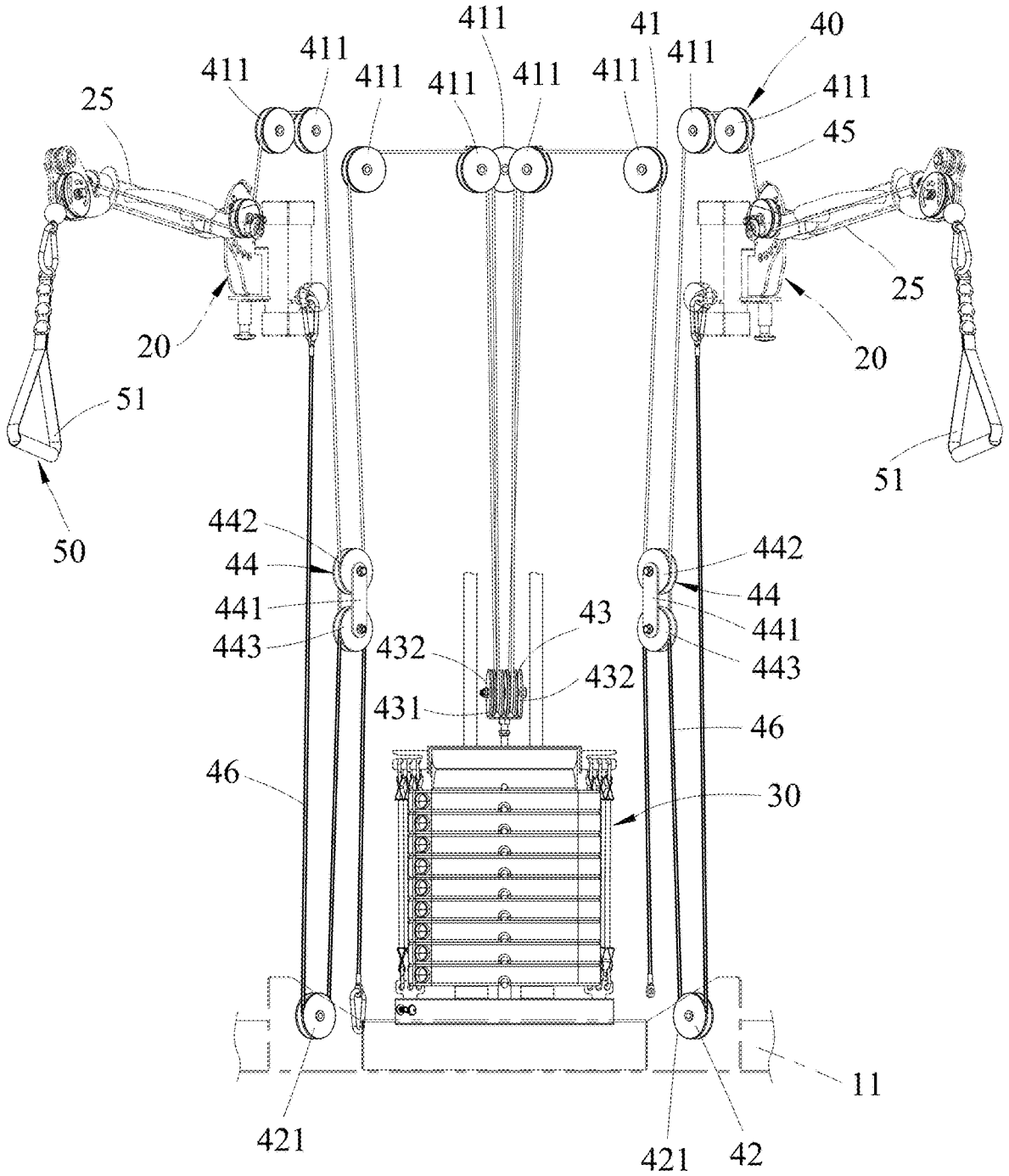
FIG. 5 is a schematic fragmentary front view of the embodiment, illustrating two adjusting units disposed at a high level.

Referring to FIG. 5, the transmission unit 40 includes a first fixed pulley set 41 mounted to the supporting unit 12, a second fixed pulley set 42 mounted to the base seat 11, a first movable pulley set 43 connected to the resistance unit 30, two second movable pulley sets 44 disposed respectively at two lateral sides of the first movable pulley set 43, an upper cable 45 looped around the first fixed pulley set 41, the first movable pulley set 43, and the second movable pulley sets 44, and two lower cables 46 looped around the second fixed pulley set 42 and respectively looped around the second movable pulley sets 44.

The first fixed pulley set 41 includes a plurality of first fixed pulleys 411 disposed above an upper portion of the supporting unit 12. The second fixed pulley set 42 includes two second fixed pulleys 421 disposed respectively at inner sides of the upright posts 13. The first movable pulley set 43 includes a first pulley frame 431, and a plurality of first movable pulleys 432 mounted to the first pulley frame 431. The selection rod 312 is co-movably connected to the first pulley frame 431. Each of the second movable pulley sets 44 includes a second pulley frame 441, an upper movable pulley 442 mounted to the second pulley frame 441 and provided for the upper cable 45 to be looped therearound, and a lower movable pulley 443 mounted to the second pulley frame 441 and provided for the respective one of the lower cables 46 to be looped therearound. The upper cable 45 is looped around the first fixed pulleys 411, the upper movable pulleys 442 of the second movable pulley sets 44, and the first movable pulleys 432. As shown in FIG. 5, each of the lower cables 46 has one end connected fixedly to the base seat 11 and another end connected to the slide seat 21 of the respective one of the adjusting units 20, and is sequentially looped around the lower movable pulleys 443 of a respective one of the second movable pulley sets 44 and a respective one of the second fixed pulleys 421. In this embodiment, the upper cable 45 is sequentially looped around two of the first fixed pulleys 411, the upper movable pulley 442 of one of the second movable pulley sets 44, another two of the first fixed pulleys 411, one of the first movable pulleys 432, one of the first fixed pulleys 411, another one of the first movable pulleys 432, another two of the first fixed pulleys 411, the upper movable pulley 442 of the other one of the second movable pulley sets 44, and another two of the first fixed pulleys 411. In this embodiment, the upper cable 45 and the lower cables 46 are steel cables, and the present disclosure is not limited hereto.

The operation unit 50 includes two operating members 51 respectively connected to two opposite ends of the upper cable 45. The operating members 51 are configured as handles, and may be respectively secured on distal ends of the swing arms 25 of the adjusting units 20 when the operating members 51 are not operated by the user (i.e., when the upper cable 45 is not pulled by the user). It should be noted that each of the operating members 51 may be other cable attachment such as ankle strap, a lat pulldown attachment, a triceps rope, a rotating bar, a V-shaped bar, etc. for training and are not limited to the handle.

To facilitate further understanding of effects, technical features, and the expected results provided by the multifunctional exercise apparatus of the present disclosure, operational details of the multifunctional exercise apparatus will be described in the following.

Figure 8:
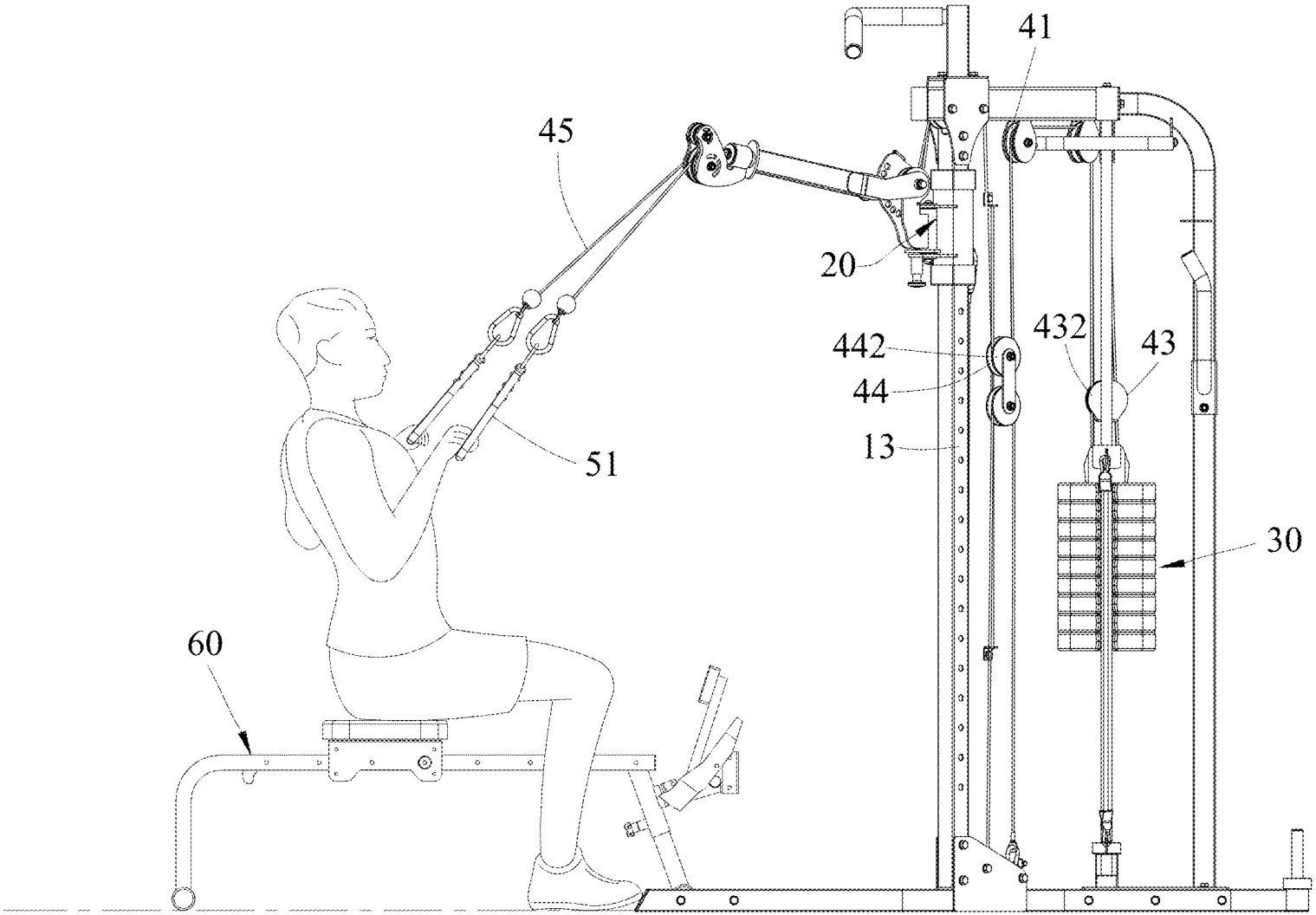
FIG. 8 is a schematic side view of the embodiment and a seat unit, illustrating how a user may train his/her back muscle.

Referring to FIG. 8, when the user wishes to begin using the embodiment to train, a seat unit 60 is first placed in front of the main frame 10 according to a type of training that the user wishes to perform. Referring back to FIG. 7, the number of the elastic straps 323 may be adjusted depending on the requirements for the training. Before the training, the two ends of a desired number of the elastic straps 323 are respectively connected to the upper hooks 321 and the lower hooks 322, and the selecting pin 314 is inserted into a selected one of the selection holes 315 of the selection rod 312 and a selected one of the weight plates 313 at a desired position. It should be noted that a height of the selected one of the selection holes 315 in the vertical direction (Z) is the same as a height of the selected one of the weight plates 313 in the vertical direction (Z).

As shown in FIG. 8, the adjusting units 20 (only one is visible) are respectively disposed at upper portions of the upright posts 13, and are located at a high level. When the user pulls the operating members 51 down, the upper cable 45 is pulled downwardly to drive the first movable pulley set 43 and the weight plate(s) 313 that is(are) disposed above the selecting pin 314 to move upwardly through guidance of the first fixed pulley set 41, the upper movable pulleys 442, and the first movable pulleys 432 around which the upper cable 45 is looped. That is to say, pulling of the upper cable 45 through the operation unit 50 drives the first movable pulley set 43 to move upwardly to thereby move upwardly the weight plates 313 disposed above the selecting pin 314 against the elastic force of the elastic subunit 32. In this way, the resistance unit 30 provides resistance against the user's pulling motion. The above setup allows the user to perform a wide grip lat pulldown exercise shown in FIG. 8, where the user is seated on the seat unit 60 and faces the multifunctional exercise apparatus. At this time, the user exerts force against a total weight of the weight plates 313 disposed above the selecting pin 314 and the elastic forces of the elastic straps 323 to perform the wide grip lat pulldown. It should be noted that the abovementioned setup also allows the user to perform a wide grip rear pulldown exercise (not shown in the drawings) by sitting in a reverse position with the user's back facing the multifunctional exercise apparatus. During the exercise, when the user pulls the operating members 51, the weight plates 313 disposed above the selecting pin 314 are first driven by the upper cable 45 via the first movable pulley set 43 to move upwardly to a certain height (a specific height position in the vertical direction (Z) depending on a height and lengths of limbs of the user, and types of exercises). Then, when the user controls descending of the weight plates 313, in addition to the weight plates 313 disposed above the selecting pin 314 that drop under the influence of gravity, a restoring force of the elastic straps 323 restores the weight plates 313 rapidly to their original positions to decrease a restoration time of the weight subunit 31, such that the user may perform a next exercise in a short period, thereby allowing the user to do cardio exercises that involve quick movements.

Figure 6:
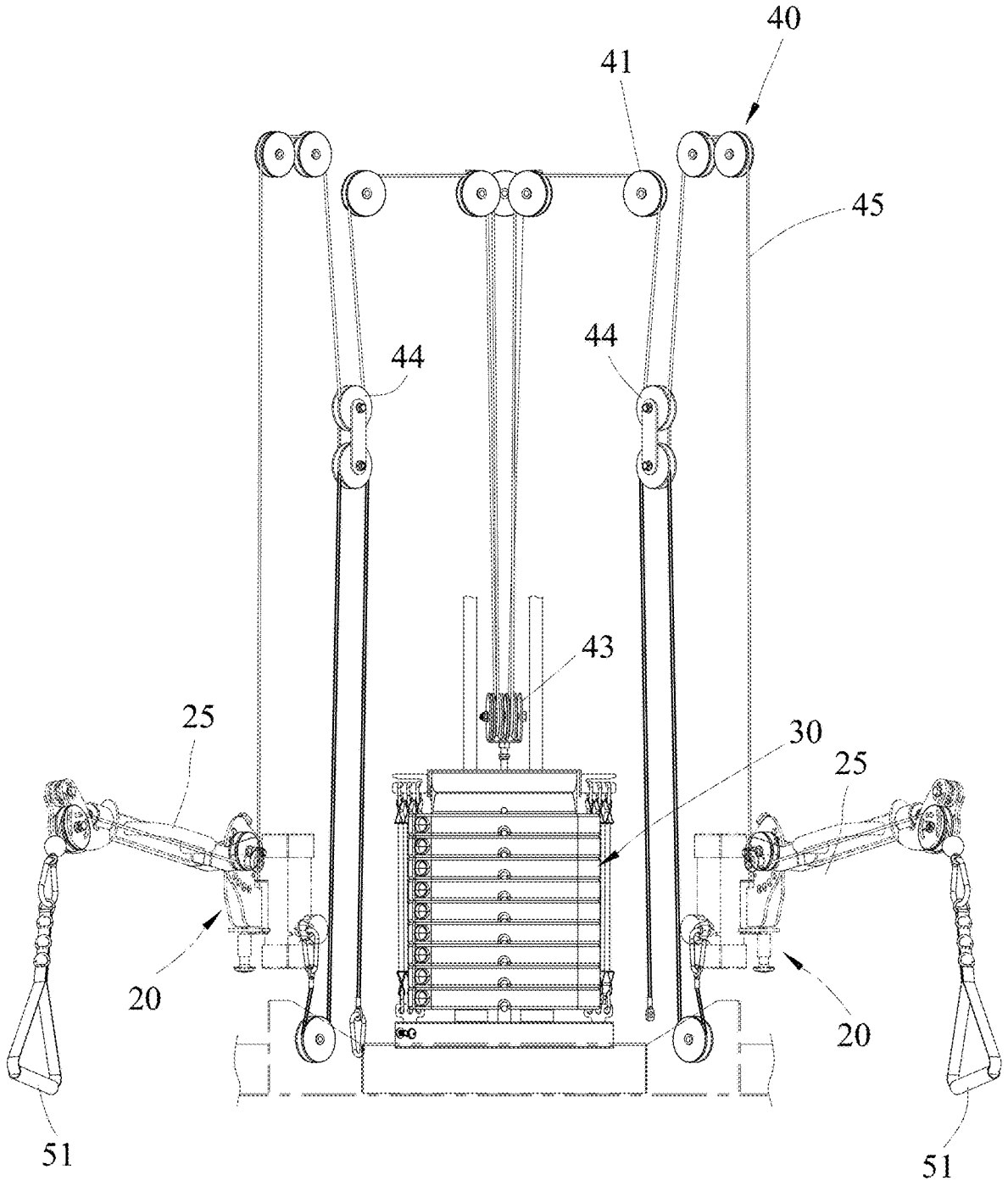
FIG. 6 is a schematic fragmentary front view of the embodiment, illustrating the adjusting units disposed at a low level.
Figure 9:
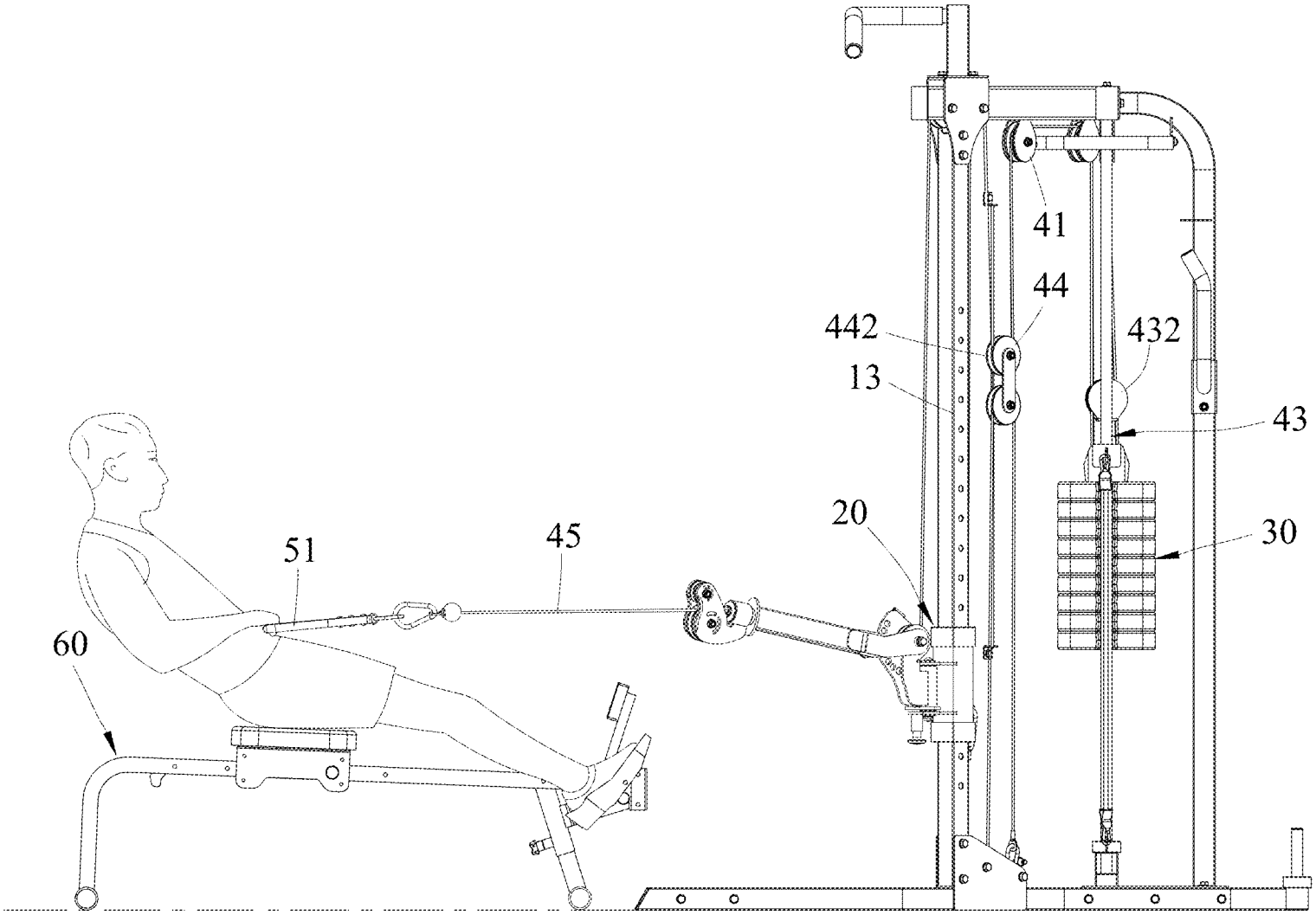
FIG. 9 is a schematic side view of the embodiment and the seat unit, illustrating how the user may perform a seated cable row exercise.

As shown in FIGS. 4, 6, and 9, the user may operate the positioning pins 22 to move the adjusting units 20 to lower portions of the upright posts 13 and to a low level lower than the high level in the vertical direction (Z). When the user pulls the operating members 51, the upper cable 45 drives the first movable pulley set 43 and the resistance unit 30 to move upwardly through guidance of the first fixed pulley set 41, the upper movable pulleys 442, and the first movable pulleys 432 around which the upper cable 45 is looped. In this way, a seated cable row exercise may be performed.

Figure 10:
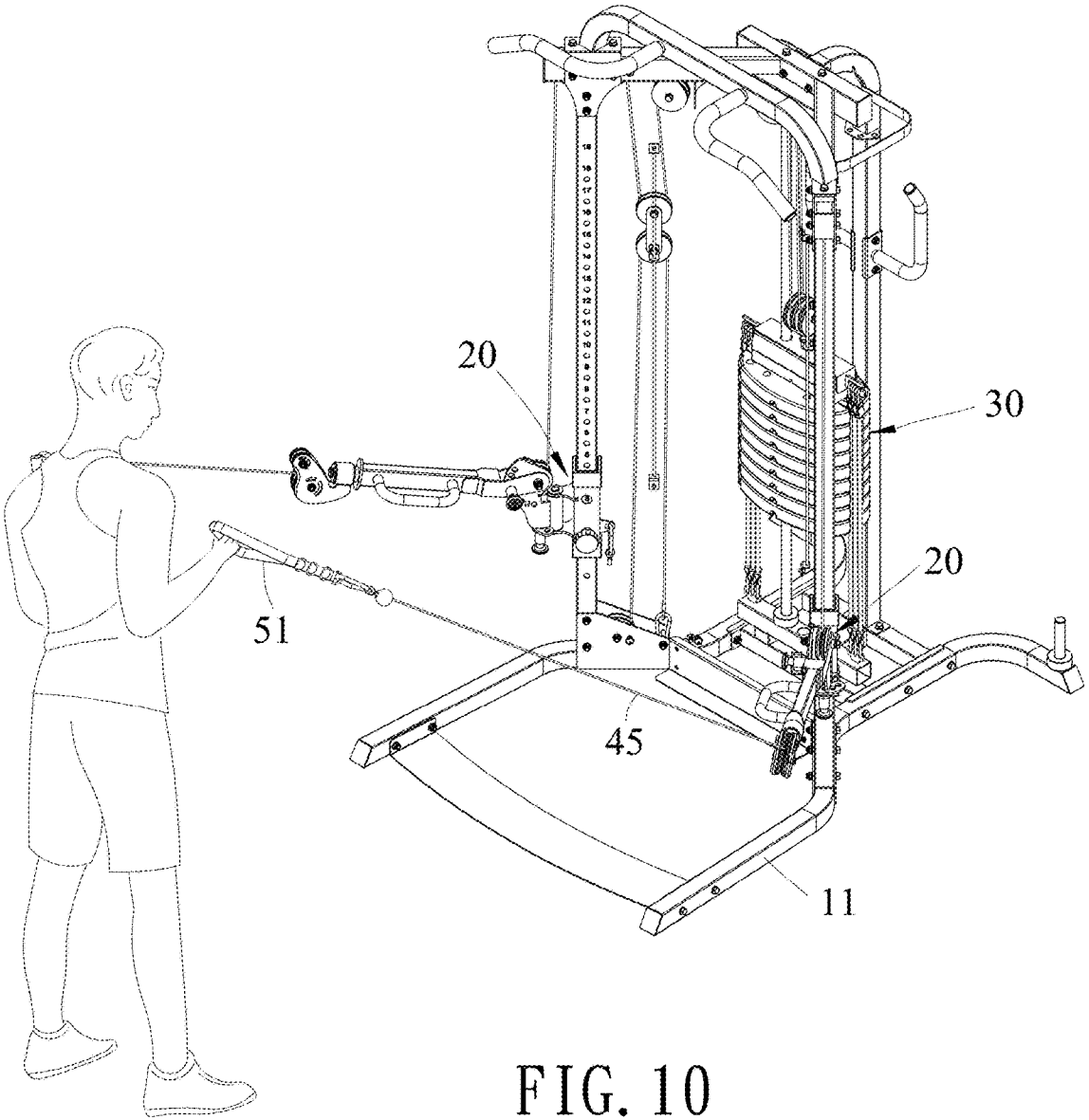
FIG. 10 is a schematic perspective view of the embodiment, illustrating how the user may perform a standing low pulley bicep curl exercise.

As shown in FIG. 10, the adjusting units 20 are located at the low level, and the user stands in front of the base seat 11 and pulls the operating members 51 against the resistance of the resistance unit 30, thereby allowing the user to perform a standing low pulley bicep curl.

Figure 11:
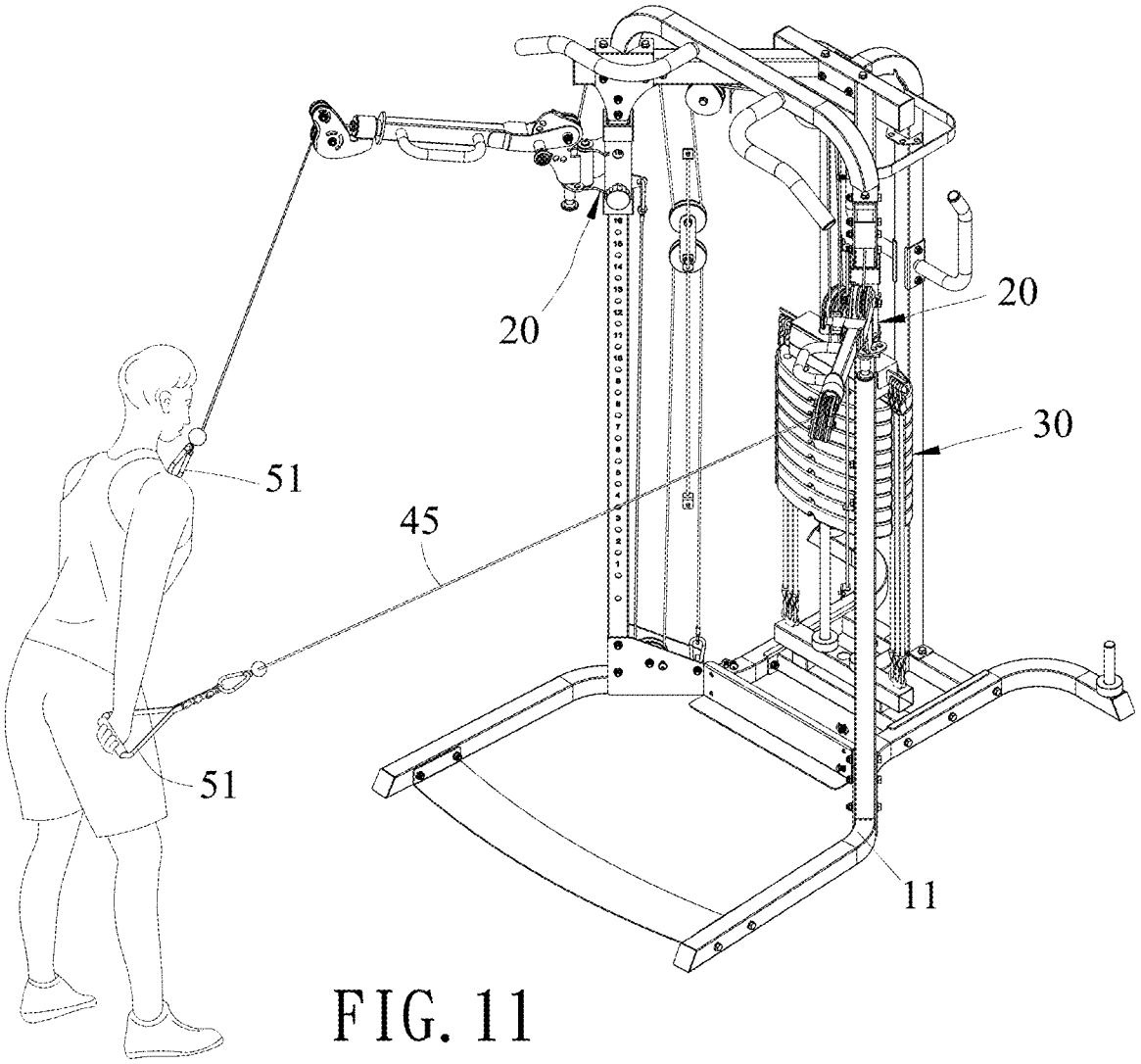
FIG. 11 is a schematic perspective view of the embodiment, illustrating how the user may perform an alternating straight arm pulldown exercise.

As shown in FIG. 11, the adjusting units 20 are located at the high level and the user alternately pulls the operating members 51 to drive movement of the resistance unit 30 via the upper cable 45 to perform an alternating straight arm pulldown exercise. It should be noted that a standing straight arm pulldown exercise may be performed from the same setup of the multifunctional exercise apparatus.

Figure 12:
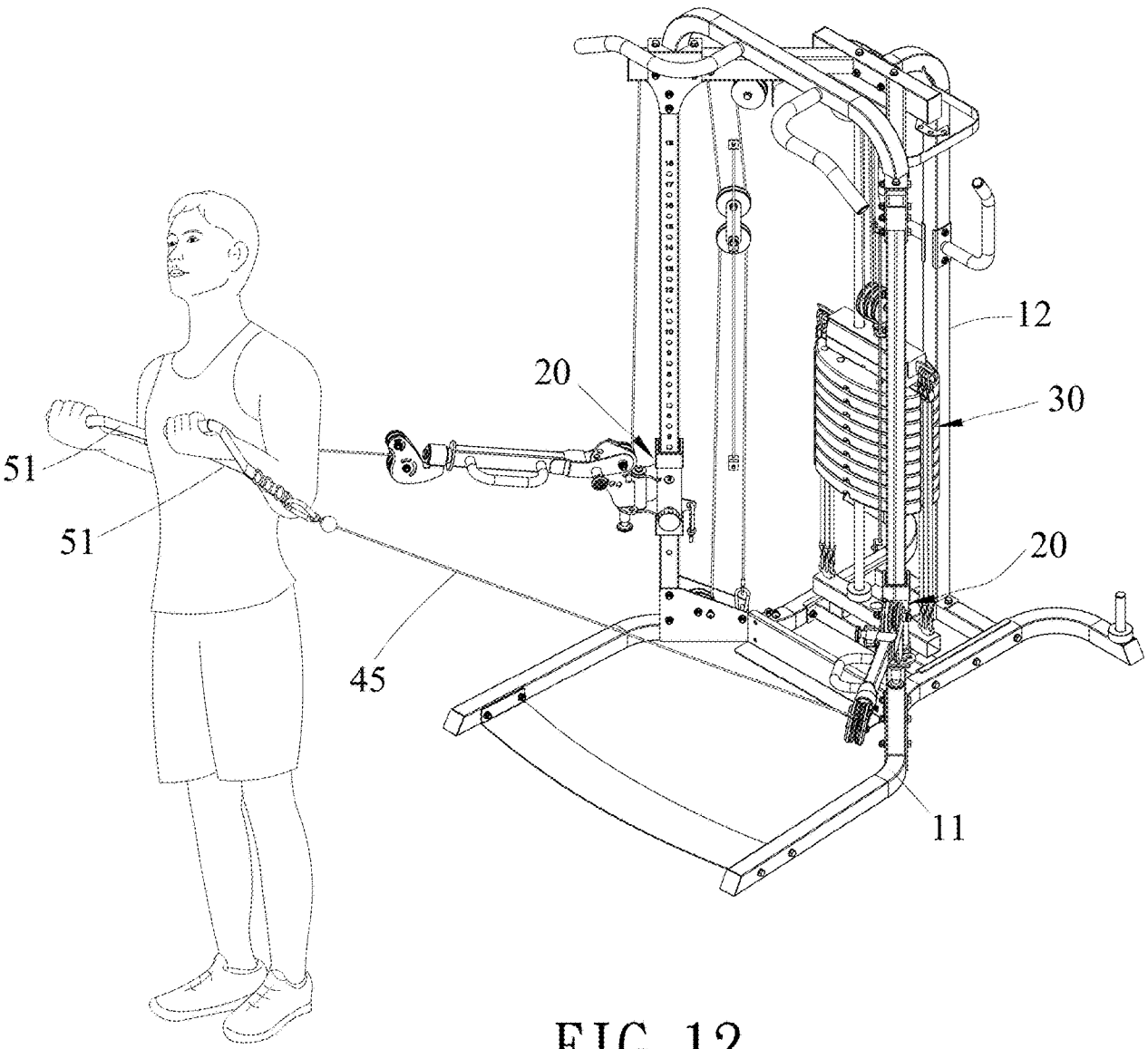
FIG. 12 is a schematic perspective view of the embodiment, illustrating how the user may perform a reverse standing low pulley bicep curl exercise.

As shown in FIG. 12, the adjusting units 20 are located at the low level, and the user stands with his/her back facing the multifunctional exercise apparatus and pulls the operating members 51 to perform a reverse low pulley standing bicep curl exercise.

Figure 13:
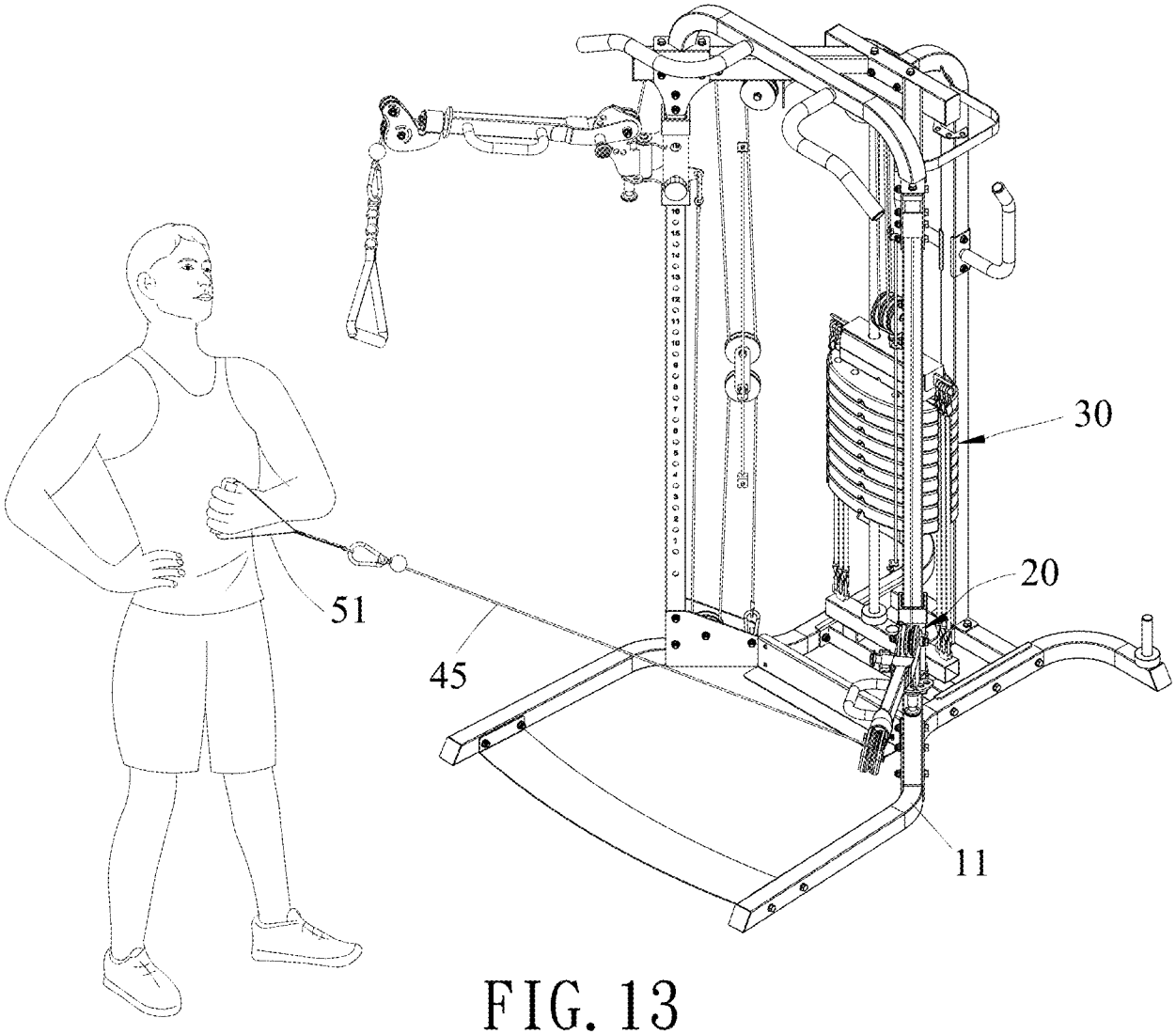
FIG. 13 is a schematic perspective view of the embodiment, illustrating how the user may perform a cross body bicep curl exercise.

As shown in FIG. 13, one of the adjusting units 20 is at the low level, and the user stands in front of the base seat 11 and is at sideways relative to the base seat 11. The user pulls one of the operating members 51 that is connected to the one of the adjusting units 20 at the low level to perform a cross body bicep curl exercise.

Figure 14:
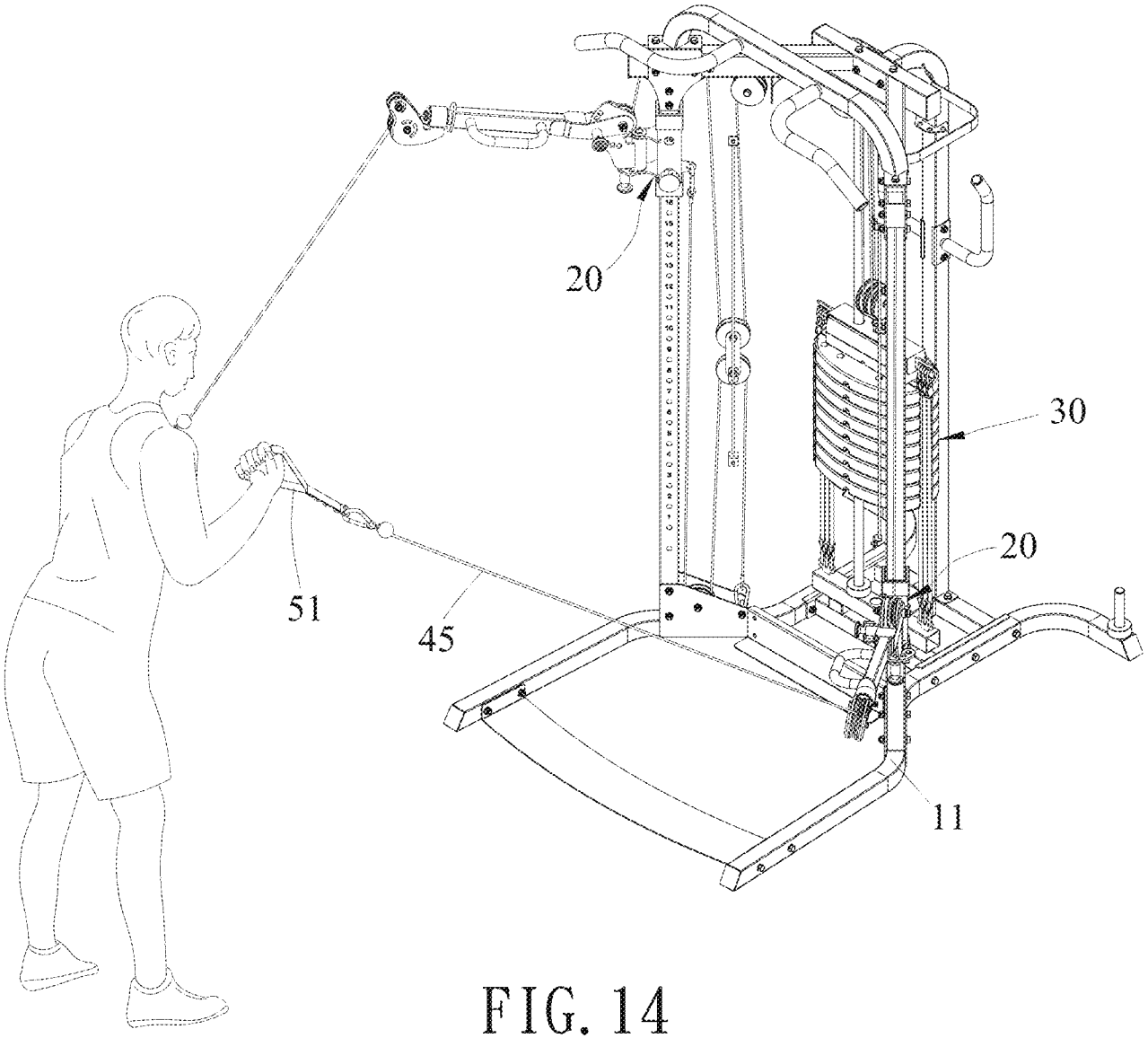
FIG. 14 is a schematic perspective view of the embodiment, illustrating how the user may perform a standing high to low cable crossover exercise.

As shown in FIG. 14, one of the adjusting units 20 is at the high level, and the other one of the adjusting units 20 is at the low level. The user pulls the operating members 51 to perform a standing high and low cable crossover exercise.

Figure 15:
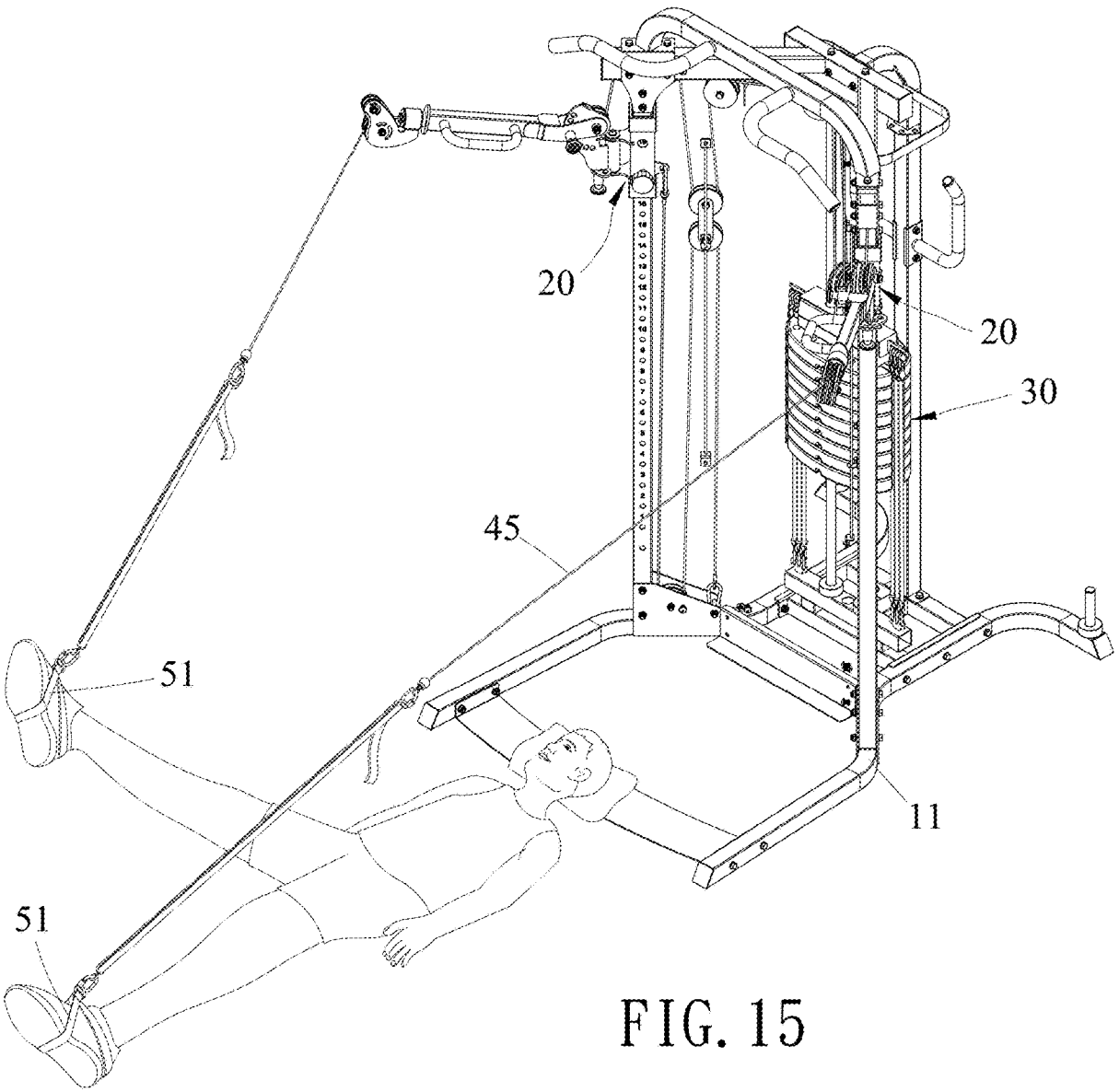
FIG. 15 is a schematic perspective view of the embodiment, illustrating how the user performing an alternating leg drop exercise on the embodiment.

Referring to FIG. 15, the adjusting units 20 are at the high level, and the user lies in front of the base seat 11 with his/her ankles attached to the operating members 51 to perform an alternating leg drop exercise.

Figure 16:
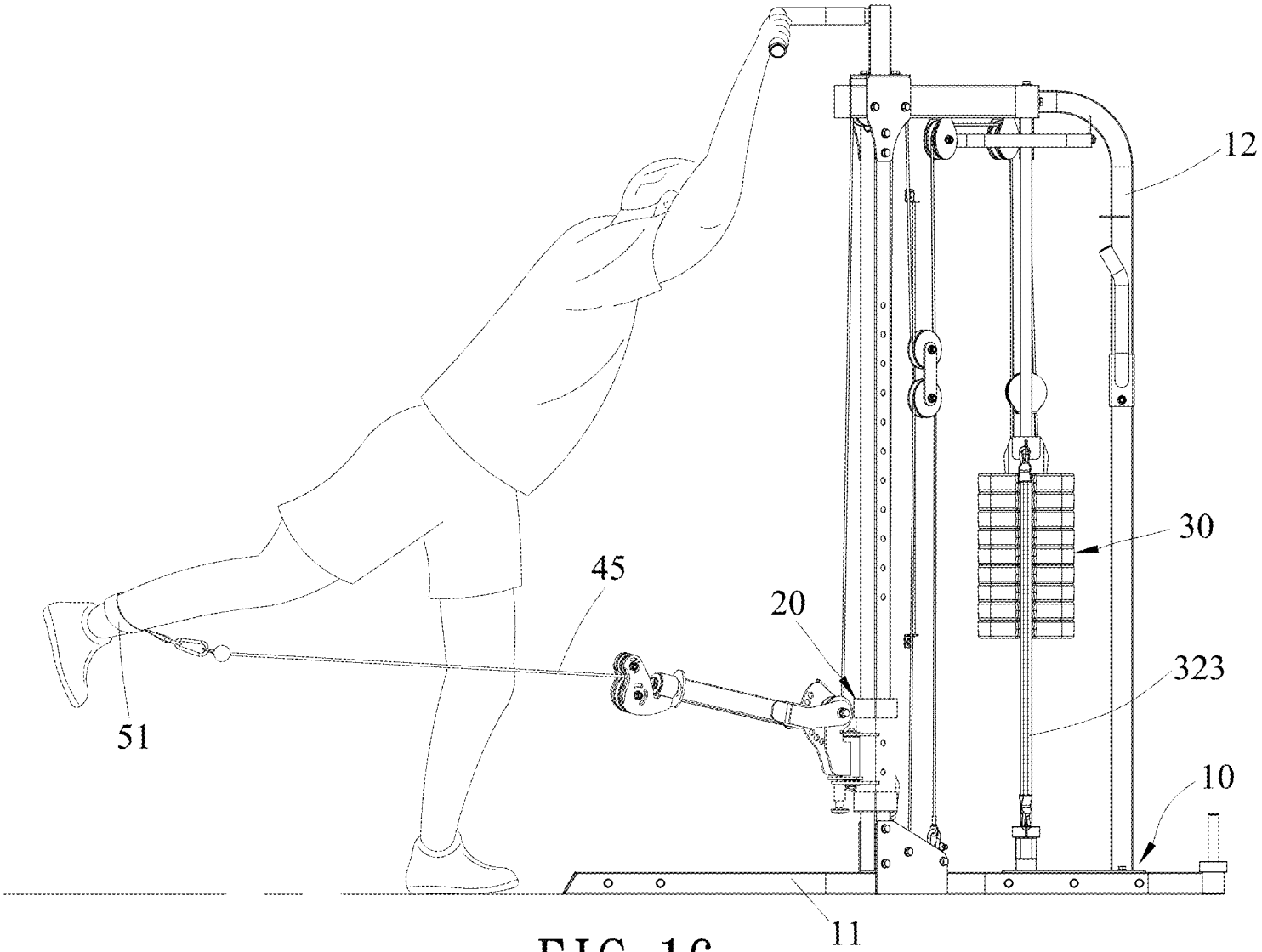
FIG. 16 is a schematic side view of the embodiment, illustrating user performing a cable glute kickback exercise on the embodiment.

Referring to FIG. 16, the adjusting units 20 are at the low level, and the user stands in front of and faces the base seat 11 with his/her ankles attached to the operating members 51 and his/her hands holding the upper portion of the supporting unit 12 to perform a cable glute kickback exercise.

Therefore, the effects and advantages of the present disclosure are summarized as follows.

First, the multifunctional exercise apparatus of the present disclosure includes a main structure of the main frame 10 and an adjusting structure of the adjusting units 20, and the main feature of the multifunctional exercise apparatus is to provide functions of both cardio training exercise and strength training exercise. Furthermore, for the sake of balance, the numbers of the elastic straps 323 that are disposed respectively at the lateral sides of the weight subunit 31 are the same, and the specifications of the elastic straps 323 are also the same. In this way, during the exercise, the weight plates 313 disposed above the selecting pin 314 are moved upwardly to a certain height (a specific height position in the vertical direction (Z) while the elastic straps 323 are stretched depending on a height and lengths of limbs of the user, and types of exercises). Subsequently, during descending of the weight plates 313, the weight plates 313 drops under the influence of gravity and are pulled by the restoring force of the elastic straps 323, so that descending of the weight plates 313 are further sped up, the restoration time is shortened, and the next exercise may be performed immediately. In this way, the user may perform a cardio exercise.

Second, in addition to the elastic straps 323 that rapidly restore the weight plates 313 to their original positions, the elastic force provided by each of the elastic straps 323 may be adjusted to three different resistance levels. That is to say, the number of the elastic straps 323 connected between the upper hook 321 and the lower hook 322 may be adjusted to provide a desired elastic force. Specifically, by choosing different number of the elastic straps 323, a demand of changing resistance for the user to train against during exercise may be satisfied. Accordingly, the user may gradually add elastic straps 323 between the main frame 10 and the first movable pulley set 43 to gradually increase the elastic force after warmup, thus the possibility of sports injuries may be reduced. This is another feature of the present disclosure. By virtue of the cooperation of the weight subunit 31 and the elastic straps 323, various resistance levels may be provided for the user to perform both cardio training exercise (e.g., rowing) and anaerobic strength training exercise. According to market research, such kind of exercise apparatus appeals to individuals who are interested in muscle building and cardio exercise.

Figure 17:
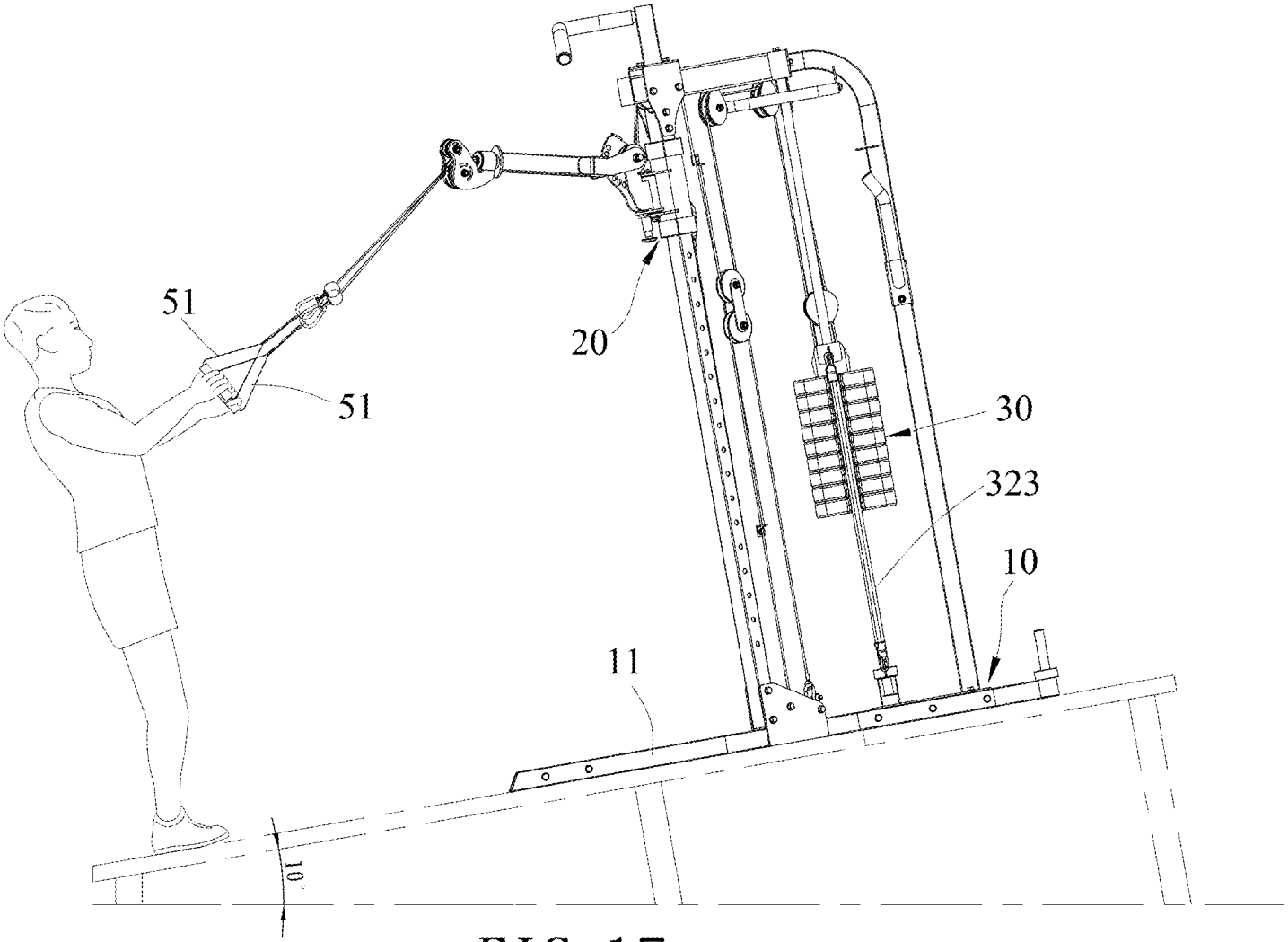
FIG. 17 is a schematic side view of the embodiment, illustrating the user using the embodiment at a declined angle.

Third, referring to FIG. 17, the multifunctional exercise apparatus of the present disclosure complies with European standards EN957-2 test methods for stationary training equipment under test conditions of an incline angle of 10° relative to the ground, a load of 100 pounds, and a total of six elastic straps 323 stretched to a maximum limit. The main frame 10 is stable and reliable, and the multifunctional exercise apparatus does not topple over.

Fourth, referring back to FIGS. 3 and 4, for each of the adjusting units 20 and the respective one of the upright posts 13, the positioning pin 22 may position the slide seat 21 relative to the upright post 13 after the slide seat 21 is moved to a desired height. For each of the adjusting units 20, the first insert pin 23 may position the rotary seat 24 relative to the one of the lug members 212 that is formed with the pin hole 214 after the rotary seat 24 is rotated to a desired angular position, and the second insert pin 26 may position the swing arm 25 relative to the pivot plates 243 after the swing arm 25 is rotated to a desired angular position. In this way, the height of the slide seat 21, the angular position of the rotary seat 24, and the angular position of the swing arm 25 of each of the adjusting units 20 may be adjusted as needed for the user to perform various exercises.

It should be noted that, referring back to FIG. 1, the multifunctional exercise apparatus further includes a control and display unit 70 mounted on the supporting unit 12 of the main frame 10, and configured to display workout data such as laps/repetitions of exercises, a current speed, an analog distance, heart rate, calories expenditure, etc. so as to provide a real-time quantitative performance feedback for the user. In this way, this may increase the user's motivation and incentivize the user to accomplish his/her workout goals. In addition, the control and display unit 70 may be controlled to output a notification signal when detecting that the workout goals are accomplished, e.g., calories expenditure exceeds a certain value.

In summary, the multifunctional exercise apparatus of the present disclosure has a simple structure, is easy to manufacture and assemble, and is useful for the user to perform both cardio training exercise and strength training exercise, so the object of the present disclosure is achieved.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A multifunctional exercise apparatus, comprising:

a main frame that includes a base seat, and a supporting unit connected to said base seat;

a resistance unit that includes a weight subunit connected to said main frame, and an elastic subunit connected between said weight subunit and said main frame;

a transmission unit that includes a first fixed pulley set mounted on said supporting unit, a second fixed pulley set mounted on said base seat, a first movable pulley set connected to said resistance unit, two second movable pulley sets disposed respectively at two lateral sides of said first movable pulley set, an upper cable looped around said first fixed pulley set, said first movable pulley set, and said two second movable pulley sets, and two lower cables looped around said second fixed pulley set and respectively looped around said two second movable pulley sets, each of said two lower cables having one end positioned to said base seat and another end connected to said supporting unit; and an operation unit that includes at least one operating member connected to one end of said upper cable.

2. The multifunctional exercise apparatus as claimed in claim 1, wherein:

said supporting unit of said main frame includes two upright posts extending upwardly from said base seat in a vertical direction, each of said two upright posts having a plurality of positioning holes that are spaced apart from each other in the vertical direction;

said multifunctional exercise apparatus further comprising two adjusting units respectively and movably connected to said two upright posts, each of said two adjusting units including a slide seat that is slidably sleeved on the respective one of said two upright posts, a rotary seat that is pivotably connected to said slide seat, and a positioning pin that is mounted on said slide seat and that extends removably into a selected one of said plurality of positioning holes of the respective one of said two upright posts; and said another end of each of said two lower cables is connected to said slide seat of a respective one of said two adjusting units.

3. The multifunctional exercise apparatus as claimed in claim 2, wherein:

said slide seat of each of said two adjusting units has a sleeve member slidably sleeved on the respective one of said two upright posts, two lug members connected to said sleeve member, one of said two lug members having a pin hole, and a pivot shaft extending through said two lug members;

said rotary seat of each of said two adjusting units includes a tubular sleeve rotatably connected to said pivot shaft of said slide seat of said adjusting unit, an adjusting plate disposed on one of said two lug members of said slide seat of said adjusting unit, connected to said tubular sleeve, and having a plurality of first adjusting holes that are arcuately arranged, and a pair of pivot plates connected to said tubular sleeve; and each of said two adjusting units further includes a first insert pin extending through said pin hole of said one of said two lug members of said slide seat, and extending removably into a a selected one of said plurality of first adjusting holes of said adjusting plate.

4. The multifunctional exercise apparatus as claimed in claim 3, wherein:

one of said pair of pivot plates of said rotary seat of each of said two adjusting units has a plurality of second adjusting holes that are arcuately arranged; and each of said two adjusting units further includes a swing arm pivotably connected to said rotary seat, and a second insert pin mounted to said swing arm and extending removably through a selected one of said plurality of second adjusting holes of said one of said pair of pivot plates.

5. The multifunctional exercise apparatus as claimed in claim 1, wherein:

said supporting unit of said main frame includes two guide rods extending upwardly from said base seat in a vertical direction;

said first movable pulley set of said transmission unit includes a first pulley frame, and a plurality of first movable pulleys mounted to said first pulley frame;

said weight subunit of said resistance unit includes a mounting seat slidable along said two guide rods, a selection rod extending into said mounting seat and co-movably connected to said first pulley frame, a plurality of weight plates sleeved removably on said selection rod and sleeved on said two guide rods, and a selecting pin extending removably through said selection rod and a selected one of said plurality of weight plates; and said elastic subunit includes a plurality of elastic straps disposed at two lateral sides of said weight subunit, each of said plurality of elastic straps having one end that is co-movably connected to said mounting seat, and an opposite end that is connected fixedly to said base seat, a first number of said plurality of elastic straps that are disposed at one of said two lateral sides of said weight subunit being equal to a second number of said plurality of elastic straps that are disposed at another one of said two lateral sides of said weight subunit.

* * * * *